United States Patent [19]

Rounsley

[11] 4,359,826

[45] Nov. 23, 1982

[54] DRYING SYSTEM

[75] Inventor: Robert R. Rounsley, Chillicothe, Ohio

[73] Assignee: The Mead Corporation, Dayton, Ohio

[21] Appl. No.: 132,442

[22] Filed: Mar. 21, 1980

[51] Int. Cl.[3] ..... F26B 7/00; F26B 20/00

[52] U.S. Cl. ..... 34/1; 34/18; 34/68; 219/10.61 R

[58] Field of Search ..... 34/1, 18, 68; 219/10.61 R

[56] References Cited

U.S. PATENT DOCUMENTS

| | | | |
|---|---|---|---|
| 894,070 | 7/1908 | Schwerin . | |
| 2,042,145 | 5/1936 | Darrah | 34/24 |
| 2,740,756 | 4/1956 | Thomas . | |
| 3,000,106 | 9/1961 | Christgau . | |
| 3,082,735 | 3/1963 | Vaccaro . | |
| 3,266,164 | 8/1966 | Bennett . | |
| 3,355,812 | 12/1967 | Bennett . | |
| 3,357,108 | 12/1967 | Bennett | 34/1 |
| 3,405,452 | 10/1968 | Candor et al. . | |
| 3,442,026 | 5/1969 | Bernard et al. | 34/1 |
| 3,449,230 | 6/1969 | Heron et al. . | |
| 3,470,621 | 10/1969 | Bennett . | |
| 3,470,716 | 10/1969 | Candor et al. . | |
| 3,491,456 | 1/1970 | Candor et al. . | |
| 3,543,408 | 12/1970 | Candor et al. . | |
| 3,546,065 | 12/1970 | Ostermeier . | |
| 3,546,783 | 12/1970 | Candor et al. . | |
| 3,633,282 | 1/1972 | Candor et al. . | |
| 3,641,680 | 2/1972 | Candor et al. . | |
| 3,667,130 | 6/1972 | Candor et al. . | |
| 3,670,606 | 6/1972 | Blomgren et al. . | |
| 3,705,847 | 12/1972 | Stiles . | |
| 3,722,105 | 3/1973 | Marteny . | |
| 3,735,175 | 5/1973 | Blomgren . | |
| 3,755,911 | 9/1973 | Candor et al. . | |
| 3,757,426 | 9/1973 | Candor et al. . | |
| 3,771,233 | 11/1973 | French et al. . | |
| 3,859,494 | 1/1975 | Spengler . | |
| 3,893,898 | 7/1975 | Candor . | |
| 3,931,682 | 1/1976 | Candor . | |
| 3,965,581 | 6/1976 | Candor . | |
| 3,966,575 | 6/1976 | Candor . | |
| 3,977,937 | 8/1976 | Candor . | |
| 3,999,302 | 12/1976 | Candor . | |
| 4,003,819 | 1/1977 | Kunkle et al. . | |
| 4,033,841 | 7/1977 | Candor . | |
| 4,050,162 | 9/1977 | Candor . | |
| 4,057,482 | 11/1977 | Candor . | |
| 4,060,449 | 11/1977 | Candor . | |
| 4,081,342 | 3/1978 | Candor . | |
| 4,110,189 | 8/1978 | Kunkle et al. . | |
| 4,111,773 | 9/1978 | Candor . | |
| 4,115,233 | 9/1978 | Griffith . | |
| 4,135,307 | 1/1979 | Candor . | |
| 4,189,845 | 2/1980 | Candor . | |
| 4,283,862 | 8/1981 | Candor | 34/1 |

FOREIGN PATENT DOCUMENTS

| | | |
|---|---|---|
| 760078 | 2/1934 | France . |

*Primary Examiner*—Larry I. Schwartz

*Attorney, Agent, or Firm*—Biebel, French & Nauman

[57] ABSTRACT

A drying system and method for removing volatile liquid from a liquid bearing web of material by evaporation includes means for moving the liquid bearing web of material through a drying station and heating means, positioned at the drying station, for applying evaporation energy to the liquid bearing web of material to effect evaporation of the volatile liquid from the web. Electrostatic means is provided for subjecting the web of material to a static electrical field at the drying station, whereby the evaporation of volatile liquid from the web is enhanced. Evaporation energy may be applied to the liquid bearing web by bringing a heated surface in contact with the web or by irradiating the web with infrared energy. Alternatively, evaporation energy may be applied to the liquid bearing web by directing heated air against the web.

11 Claims, 18 Drawing Figures

DRYING SYSTEM

BACKGROUND OF THE INVENTION

The present invention relates to an improved drying apparatus and method for removing volatile liquid from a liquid bearing web of material, which apparatus and method may find particular application in drying a web moving web of paper or like material.

In conventional paper manufacturing processes, a slurry of fibers and water in a head box is permitted to flow onto a support of woven wire material, known as a Fourdrinier wire belt which is moved beneath the head box at a uniform speed. Water drains through the Fourdrinier belt, thus leaving a thin layer of intermeshed fibers. Drainage of the water from the fibers may be assisted by suction boxes beneath the Fourdrinier belt. The resulting web may be transferred onto a felt belt for further drying. Water may also be removed from the web by feeding it between a series of press rollers and between felt covered rolls. The paper web may then pass around a series of steam heated iron cylinders such that these cylinders heat the paper web sufficiently to cause evaporation of the remaining moisture.

In order to hold the web of paper firmly against the steam heated dryer drums, a dryer felt web may also be guided around the heated dryer drum overlaying the paper web. THe dryer felt web is maintained under tension so as to apply a uniform pressure against the paper web, thus improving the conduction of heat from the steam heated drum into the moisture bearing paper web. Since, under normal operating conditions, the dryer felt web is not intended to absorb water in liquid form, it is typically formed of a hard, generally non-absorbent fabric.

Other web drying techniques have also been used in the past to apply heat to the moving paper web so as to cause the moisture to evaporate from the web. In one technique, the web is passed beneath a series of gas burners which direct radiant infrared energy at the web. In another type of drying, the web is passed through a drying tunnel in which a plurality of air nozzles direct heated air against the web. This convection heating process is particularly useful in the final drying stages of the paper making process.

It has been found that the use of an electrostatic field may facilitate certain moisture removing techniques. U.S. Pat. No. 3,771,233, issued Nov. 13, 1973, to French et al, discloses a method of applying a high voltage direct current discharge to a liquid or a solid mass containing liquid, while the surface of the liquid or solid mass is in contact with a circulating gaseous atmosphere. Evaporation of the liquid is promoted by this technique due to turbulence of the atmosphere brought about by the discharge adjacent the surface of the liquid. The French et al disclosure is directed specifically to drying investment casting shell molds. The mold is placed in an oven for evaporation drying. The positive terminal of a high voltage d.c. power source is connected to the mold and to ground and a negative terminal of the power source is connected to a plurality of needlelike electrodes which surround but do not contact the mold.

Another approach to drying is disclosed in U.S. Pat. No. 2,740,756, issued Apr. 3, 1956, to Thomas in which a liquid bearing material, such as a paper web, is subjected to a high frequency pulsating uni-directional field. The field is said to drive the water out of the material web in liquid form without vaporizing the water. In the final drying phases, a high frequency bi-directional fluctuating field is preferred, however, for heating material having a relatively low percentage water content to cause evaporation.

A number of U.S. patents, issued to Robert R. Candor and James T. Candor, relate to the use of a static electrical field to assist in removal of water in a liquid form from various types of material, including paper, by causing the water to migrate physically in the direction of the field out of the moisture bearing material. These patents include U.S. Pat. Nos. 3,633,282, issued Jan. 11, 1972; 3,543,408, issued Dec. 1, 1970; 3,641,680, issued Feb. 15, 1972; 3,755,911, issued Sept. 4, 1973; 3,757,426, issued Sept. 11, 1973; 3,931,682, issued Jan. 13, 1976; 3,999,302, issued Dec. 28, 1976; and 3,977,937, issued Aug. 31, 1976.

The various embodiments disclosed in these patents relate to the removal of water from a moisture bearing web in liquid form. Although the Candor '282 patent discloses, in FIGS. 7 and 8, the use of a nonuniform electrostatic field in conjunction with a steam heated roll, each of the rolls has associated therewith a moisture absorbing felt web into which the moisture is driven, apparently in liquid form, by an electrostatic field produced between a plurality of small electrodes adjacent the drum and the grounded metal stem heated drum. Various other embodiments of the Candor invention are suggested but, as stated above, in each case the devices are intended to extract liquid water from the paper web without vaporization.

Additionally, the paper drying devices disclosed in the Candor patents are generally of the type which subject the paper web to a field by placing oppositely charged electrodes on opposite sides of the web or, in the case of the embodiment of FIG. 7 of the Candor '3,757,426 patent, by electrically connecting one side of a high potential source to the slurry forming the wet web and connecting the opposite side of the high potential source to a plurality of electrodes positioned beneath the web. It should be appreciated that an opposing electrode configuration may not be practicable in evaporation drying devices where heating apparatus must be positioned on one side of the paper web.

The Candor patents further suggest the use of suction, as in Candor '3,757,426, to assist in the removal of liquid water, as well as the use of vibrational energy or soundwaves, as in the Candor '3,931,682 and '3,641,680 patents, in conjunction with the use of an electrostatic field for removal of the liquid water. The Candor '3,999,302 patent further suggests dielectric heating in conjunction with electrostatic and vibratory liquid water removal, while the '3,977,937 patent suggests the use of patterned conductive belts for supporting the paper web and rearranging the position of the web fibers.

Removal of water in liquid form, however, is practicable only during the initial drying phases where the paper material still has a relatively high water content. For a paper web to be dried completely, however, it is necessary to supply heat in some manner to the paper web to evaporate the small remaining amounts of moisture. Evaporation is also the preferred drying mechanism where a web of material has been coated with a coating composition in liquid solution or suspension and it is desired to remove the liquid to produce a dry coated web. It will be appreciated that the known evaporation drying techniques require the application of substantial quantities of energy to the paper web and that, therefore, the drying efficiency of such techniques is extremely important. A number of Candor patents, such as U.S. Pat. Nos. 3,966,575; 4,081,342; 4,057,482; and 4,033,841, disclose drum dryers in which a plurality of electrode pairs, each pair including electrodes differing substantially in area, are provided on opposite sides of a web of moist paper. Half of the electrodes are positioned within the drum which must therefore be nonmetallic, so as not to shield the electrodes.

Accordingly, it is seen that there is a need for a simple drying system and method for high efficiency evaporation drying of the type which is used for drying moisture bearing paper and coated paper material.

SUMMARY OF THE INVENTION

A drying system for removing volatile liquid from a liquid bearing web of material by evaporation includes means for moving a liquid bearing web of material through a drying station. A heating means, positioned at the drying station, applies evaporation energy to the liquid bearing web of material to effect evaporation of the liquid from the web. An electrostatic means subjects the web of material to a static electrical field at the drying station, thereby enhancing the evaporation of volatile liquid from the web.

The heating means may comprise a rotatable heated cylindrical drum in contact with the liquid bearing web and belt means contacting the liquid bearing web and urging the web against the drum. Alternatively, the heating means may comprise a source of radiant energy, including a plurality of infrared burners, positioned above the web at the drying station. Finally, the heating means may comprise means for directing heated air against the web at the drying station.

The electrostatic means may comprise a plurality of electrodes positioned at the drying station and spaced apart along the web in the direction of web movement through the drying station. The electrostatic means further includes means for supplying static electrical potentials to selected ones of the plurality of electrodes. The electrodes may all be positioned on one side of the web with a first static electrical potential supplied to a number of the electrodes and a second static electrical potential supplied to others of the electrodes. The first static electrical potential may be supplied to alternate electrodes along the web of material, and the second static electrical potential may be supplied to electrodes positioned intermediate the alternate electrodes.

Where a heated cylindrical drum is used as the heating means, the electrodes may be positioned circumferentially around the drum and outwardly from the web with each of the electrodes extending across the width of the web. The electrostatic means may further comprise frame means including a pair of nonconductive supports extending circumferentially around the drum, with the supports being spaced apart in a direction parallel to the axis of rotation of the drum by a distance at least as great as the width of the moisture bearing web. Each of the electrodes in such an arrangement comprises an electrode wire extending between the supports and connected to receive one of the first and second static electrical potentials. The frame means may further comprise means for tensioning the electrode wires across the supports.

Where the heating means comprises a plurality of infrared burners positioned above the web, the electrostatic means may comprise a plurality of electrodes positioned beneath the web. Each electrode may comprise an elongated electrode member extending across the width of the web, with each electrode member being connected to receive one of the first and second static electrical potentials.

Where the heating means comprises means for directing heated air against the web, the electrodes may each comprise a sheet of electrically conductive material extending across the width of the web and providing a substantial electrode area.

The method of removing volatile liquid from a liquid bearing web of material by evaporation comprises the steps of:

(a) moving a liquid bearing web of material through a drying station, (b) applying evaporation energy to the liquid bearing web of material at the drying station to effect evaporation of liquid from the web, and (c) subjecting the liquid bearing web of material to a static electrical field, whereby evaporation of volatile liquid from the web is enhanced.

The step of applying an evaporation energy to the liquid bearing web of material may include the step of heating the liquid bearing web by irradiating the web with infrared energy. Alternatively, this step may include the step of directing heated air against the liquid bearing web.

The step of subjecting the liquid bearing web of material to a static electrical field may include the step of subjecting the liquid bearing web to a nonuniform static electrical field.

Accordingly, it is an object of the present invention to provide a drying system and method for removing volatile liquid from a liquid bearing web of material by supplying evaporation energy to the web and by subjecting the web to a static electrical field, thereby enhancing the evaporation of liquid from the web; to provide such a system and method in which the evaporation energy is provided by a heated cylindrical drum in contact with the web; to provide such a system and method in which the evaporation energy is supplied to the web by a source of radiant energy; to provide such a system and method in which evaporation energy is supplied to the web by directing heated air against the web; to provide such a system and method in which the static electrical field is provided by a plurality of electrodes maintained at one or more electrical potentials; to provide such a system and method in which the electrodes are positioned along the web in the direction of web movement; to provide such a system and method in which the electrodes are all positioned to one side of the web; and to provide such a system and method in which a nonuniform static electrical field is provided by the electrodes.

Other objects and advantages of the invention will be apparent from the following description, the accompanying drawings and the appended claims.

DETAILED DESCRIPTION OF THE PREFERRED EMBODIMENTS

Figure 1:
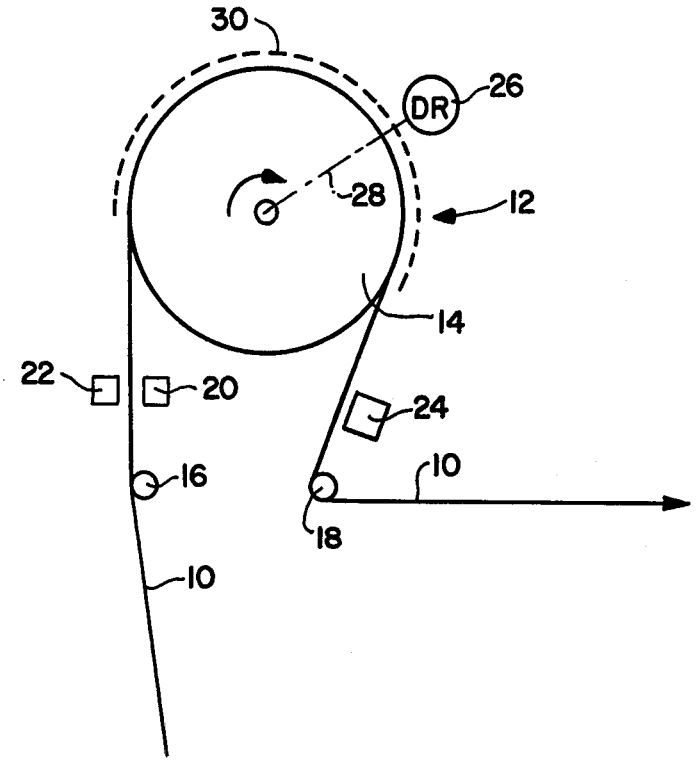
FIG. 1 is a diagrammatic view of a first embodiment of the present invention in which evaporation energy is provided by a heated cylindrical drum.

Reference is made to FIGS. 1-8 which illustrate first and second embodiments of the present invention. The drying system of the present invention removes volatile liquid, such as water, from a liquid bearing web of material 10 by evaporation, with the web 10 being moved through a drying station, indicated generally at 12. Web 10, which may consist of a wet paper web is guided around a heating means 14, in this case, a heated cylindrical dryer drum, by means of guide rolls 16 and 18. Gauges 20, 22, and 24 may be utilized to measure the moisture content of the web 10 before and after the drying operation.

Drum 14 is a steam heated metal drum of standard construction. Such a drum is typically hollow and receives a continuous supply of steam to its interior cavity such that the drum is heated as it is rotated by a drive motor 26 connected by appropriate drive linkage 28. Drum 14 applies evaporation energy to the moisture bearing web of material to effect evaporation of the moisture from the web in a known manner. It has been found, however, that by providing an electrostatic means for subjecting the web of material to a static electrical field at the drying station, evaporation of moisture from the web is enhanced.

A plurality of electrodes are positioned along dashed line 30 at the drying station and are spaced apart along the web 10 in the direction of web movement, and positioned around the periphery of the drum, outwardly from the web. A static electrical field is provided at the drying station by supplying static electrical potentials to selected ones of the plurality of electrodes positioned along line 30, as discussed more completely below. It should be appreciated that rotatable heated cylindrical drum 14 is held in contact with the moisture bearing web 10 as the web moves through the drying station, with the motor 26 and linkage 28 providing a means for rotating the drum such that the periphery of the drum moves at the same speed as the web 10.

Figure 2:
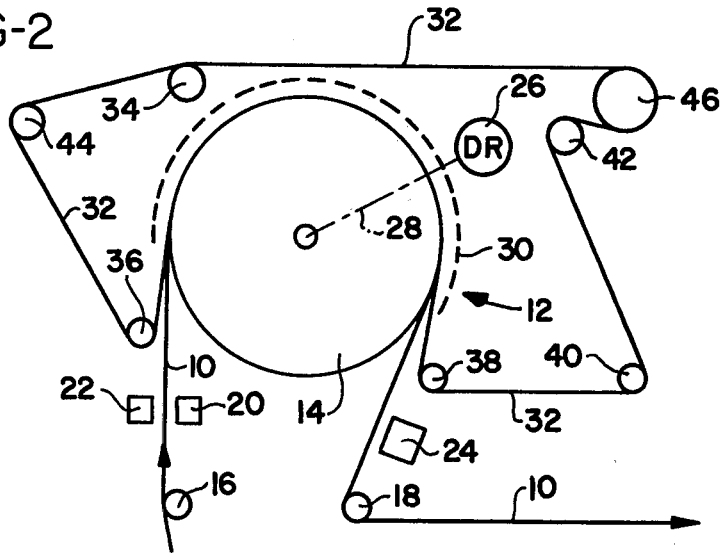
FIG. 2 is a diagrammatic view of a second embodiment of the present invention in which evaporation energy is provided by a heated cylindrical drum and in which a dryer felt web is utilized.
Figure 3:
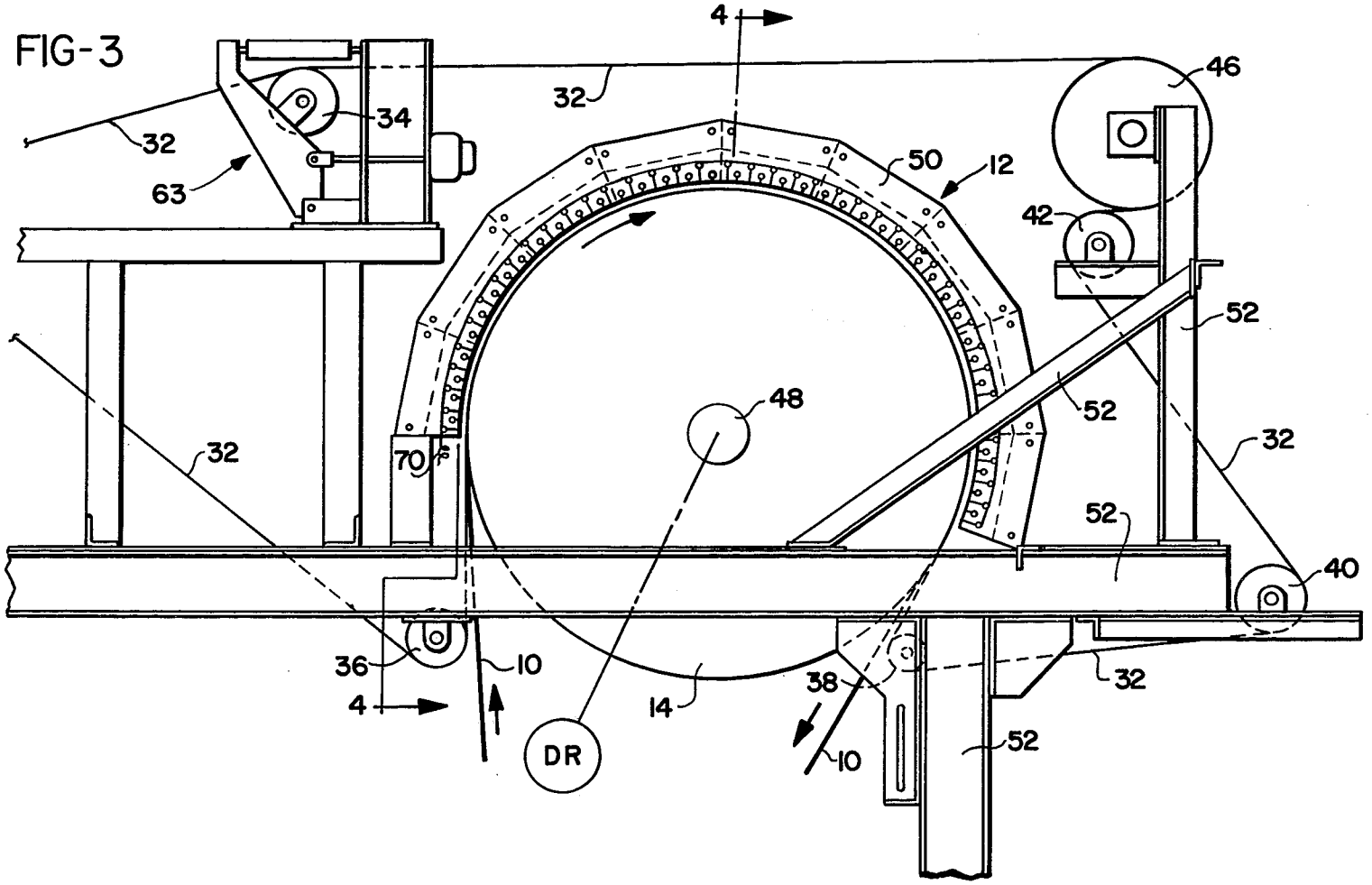
FIG. 3 is a view, similar to FIG. 2, illustating the embodiment of FIG. 2 in greater detail.
Figure 4:
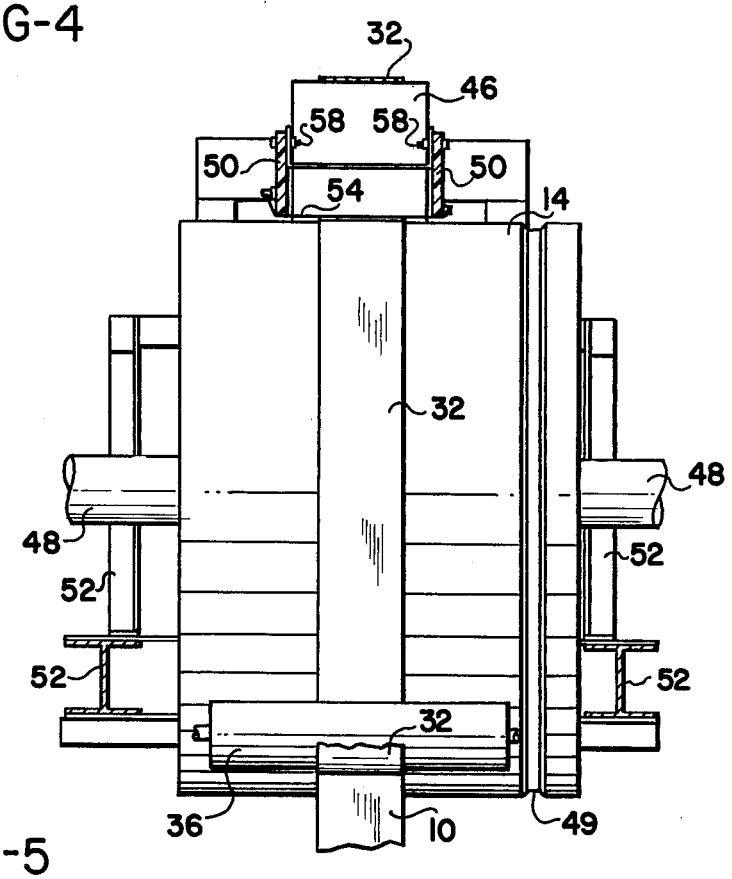
FIG. 4 is a sectional view taken generally along line 4—4 in FIG. 3.

FIG. 2 illustrates a second embodiment of the present invention which is similar to the embodiment of FIG. 1 and in which common structure has been indicated with corresponding reference numerals. In the embodiment of FIG. 2, a belt means, including dryer felt web 32, is provided for contacting the liquid bearing web 10 and urging the web 10 against the drum 14. The dryer felt web 32 passes around guide rolls 34, 36, 38, 40 and 42, tensioning roll 44, and honeycomb roll 46. Rotation of the drum 14 in contact with the dryer felt web causes the web 32 to be transported through its associated guide rolls. The drying mechanism by which water or other fluid is removed from the web 10 is an evaporation process, with the dryer felt web 32 being a hard fabric material which is utilized to press the paper web 10 against the drum 14 so as to enhance the conduction of heat from the drum 14 to the web 10.

FIGS. 3-8 illustrate the details of construction of the drying system of FIG. 2 in greater detail. It should be understood, however, that the drying system of FIG. 1 is constructed in an identical manner, with the exception that the dryer felt web 32 and associated rolls are not provided. The drum 14 is mounted for rotation on hollow shafts 48 by a mounting arrangement (not shown). Steam is supplied through shafts 48 such that the drum 14 is heated. An electrostatic means for subjecting the web of material to a static electrical field at the drying station includes frame means consisting of a pair of nonconductive supports 50 which extend circumferentially around drum 14. Supports 50 are spaced apart in a direction parallel to the axis of rotation of the drum 14 by a distance at least as great as the width of the moisture bearing web 10. Supports 50 are mounted on mounting structure 52 which also provide support for the rollers associated with the dryer felt web 32. A plurality of electrodes, each comprising an electrode wire 54, extend between the supports 50 and are connected to receive static electrical potentials for creation of the desired static electrical field.

Nonconductive supports 50 are attached to support bars 56 by bolts 58 which extend through nonconductive supports 50 and bars 56 to engage nuts 60. Support bars 56 are, in turn, secured to the support frame 52. A plurality of cross support members 62 extend between the support bars 56 and may be welded thereto. A dryer felt web release 63 is also mounted on support frame 52 to permit web 32 to be removed.

Figure 5:
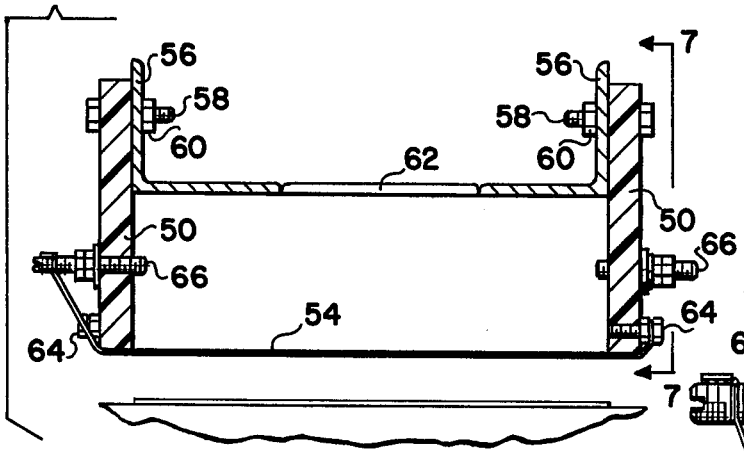
FIG. 5 is an enlarged sectional view of the upper portion of FIG. 4.
Figure 6:
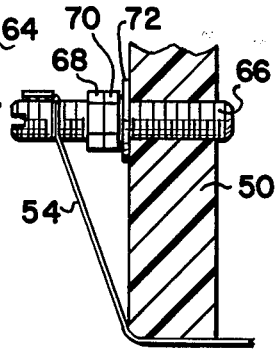
FIG. 6 is an enlarged sectional view of the lower left-hand portion of FIG. 5.

Each of the electrode wires 54 extends between a bolt 64 secured in one of the nonconductive supports 50 and a threaded rod 66 secured in the opposing support 50. As seen in FIGS. 5 and 6, rod 66 is not threaded into support 50, but rather simply is received into an opening in the support. The rod 66 is held in position by the tension applied to the rod by means of the tensioned electrode wire 54 which is soldered to the end of rod 66. The tension of wire 54 may be adjusted by altering the position of rod 66 in support 50 by means of a pair of nuts 68, which also serve to engage a conductor 70 against washer 72. By applying an electrical potential to conductor 70, static electrical potentials may be applied to the electrode wires 54 as desired.

Figure 7:
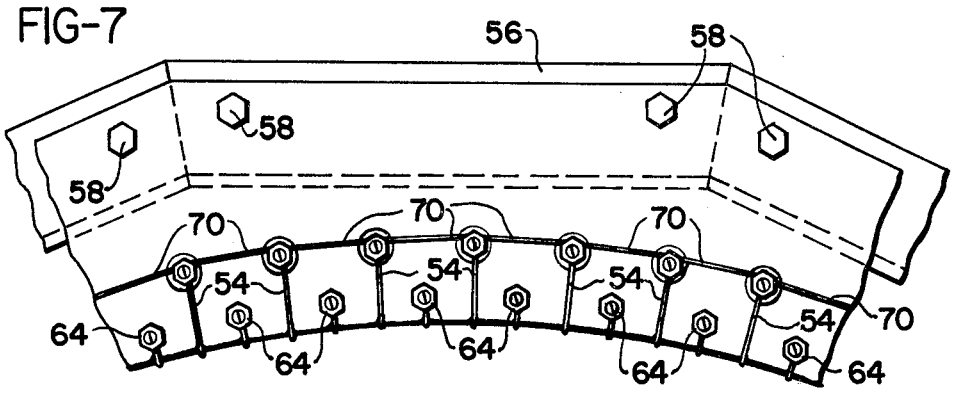
FIG. 7 is an enlarged view of a portion of the embodiment of FIG. 3, taken generally along line 7—7 in FIG. 5.
Figure 8:
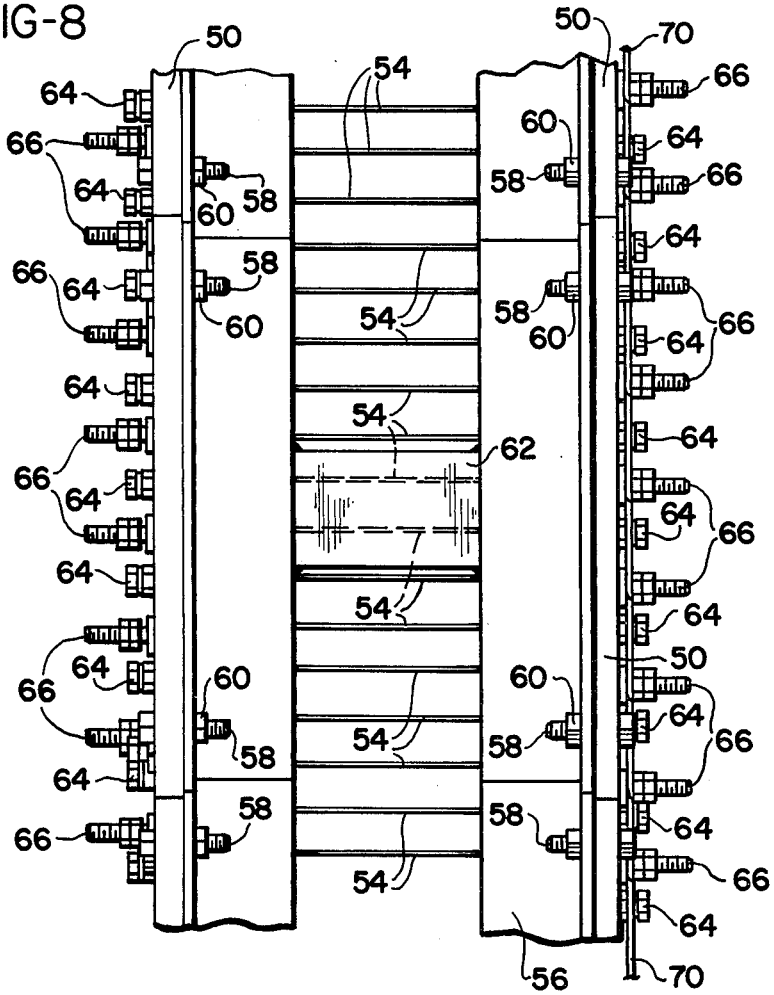
FIG. 8 is an enlarged partial plan view of the embodiment of FIG. 3.

As shown in FIGS. 7 and 8, a conductor 70 supplies a first static electrical potential to alternate electrodes along the web and is connected to alternate electrodes via the threaded bolts 66 extending from the right-hand nonconductive support 50. If desired, a second conductor may extend between each of the threaded rods 66 in the left hand support 50 of FIG. 8 so as to provide a means for supplying a second static electrical potential to each of the intermediate electrode wires 54. This second electrical conductor is removed in FIG. 8 for purposes of clarity.

It has been found that various electrical field configurations may be utilized in the drying technique of the present invention, all of which enhance evaporation of moisture from the web 10. If desired, all of the electrode wires 54 may receive a static electrical potential on the order of 10000 volts. Alternatively, alternate electrode wires 54 may be connected to a high voltage source, with intermediate electrode wires remaining unconnected. As a further alternative, a first static electrical potential, on the order of 10000 volts, may be supplied to alternate electrode wires 54, with a second static electrical potential, such as ground potential, being supplied to the intermediate electrode wires.

It would appear from a number of tests that the use of first and second static electrical potentials being connected to alternate electrode wires to produce a nonuniform electrical field through which the moisture bearing web moves at the dryer station produces the greatest enhancement of evaporation drying of the web. In tests conducted utilizing the drum dryer arrangement of FIG. 3 without the dryer felt web 32, an average increase in drying rate of 6.3% was noted with a moisture bearing paper web. In similar tests utilizing the dryer felt web 32, an average drying rate increase of 5.7% was noted with a moisture bearing paper web. A summary of tests utilizing the drum dryer with a dryer felt web is set out in appendix A, while a similar summary of tests utilizing a drum dryer without the dryer felt web is given in appendix B.

Figure 9:
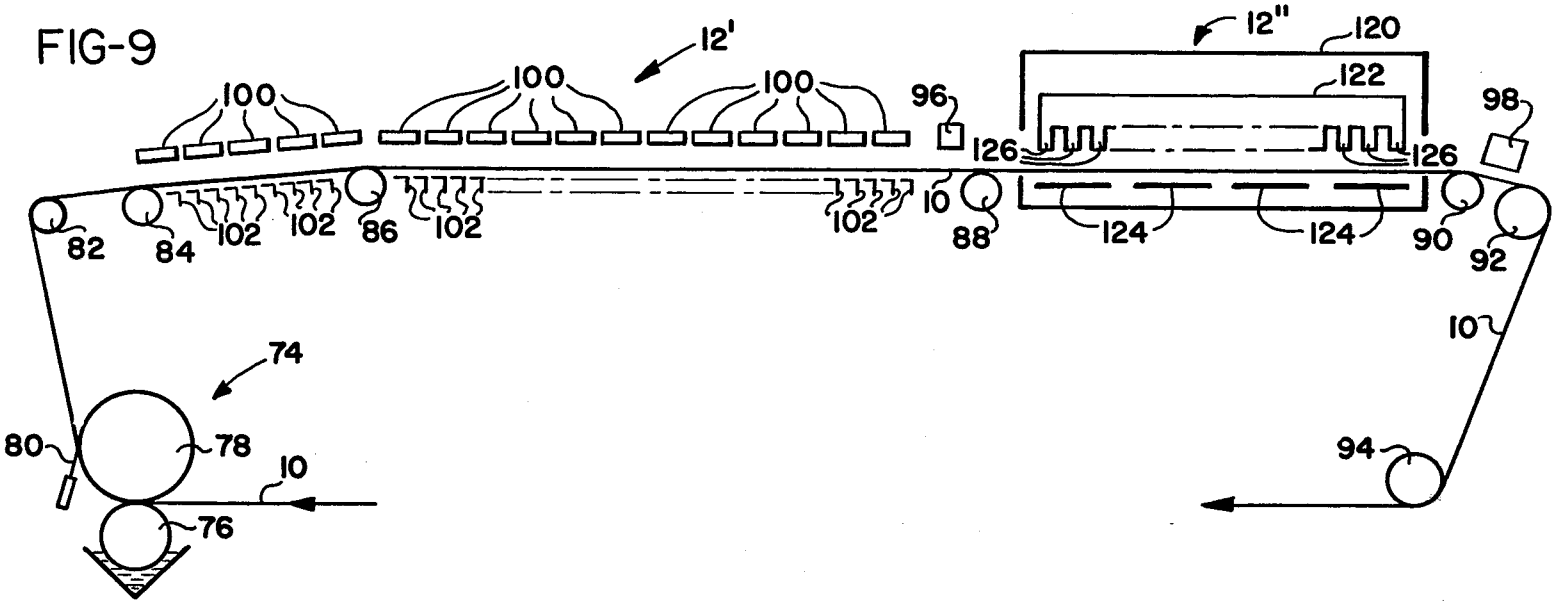
FIG. 9 is a diagrammatic view illustrating a third embodiment of the present invention in which evaporation energy is provided by a plurality of infrared burners and, further, illustrating a third embodiment of the present invention in which evaporation energy is provided by means of heated air.

Reference is now made to FIG. 9 which illustrates third and fouth embodiments of the present invention. A liquid coating composition is applied to the web 10 at a coating station 74 where the web passes between a rotating coating roll 76 and an opposing roll 78. Excess coating fluid is removed from the web by a doctor 80. Web 10 then passes through a first drying station 12' and, subsequently through a second drying station 12'', guided by guide rolls 82, 84, 86, 88, 90, 92, and 94. The moisture content of the web 10 leaving the first drying station 12' is measured by gauge 96, while moisture content of the web 10 leaving the second drying station is measured by gauge 98. Although these two embodiments of the present invention are illustrated as operating in tandem, it should be understood that either may be used alone or in combination with other drying apparatus.

The third embodiment of the present invention at drying station 12' is a drying system in which the heating means includes a plurality of radiant burners 100 positioned above the web 10. Burners 100 are gas fired infrared burners of standard design which radiate infrared energy onto the web 10 to effect evaporation of the moisture carried by the web. A plurality of electrodes 102 are positioned beneath the web and selected ones of the electrodes 102 receive static electrical potentials to produce a static electrical field which enhances evaporation of moisture from the web.

Figures 10, 11, 12, 13, 14:
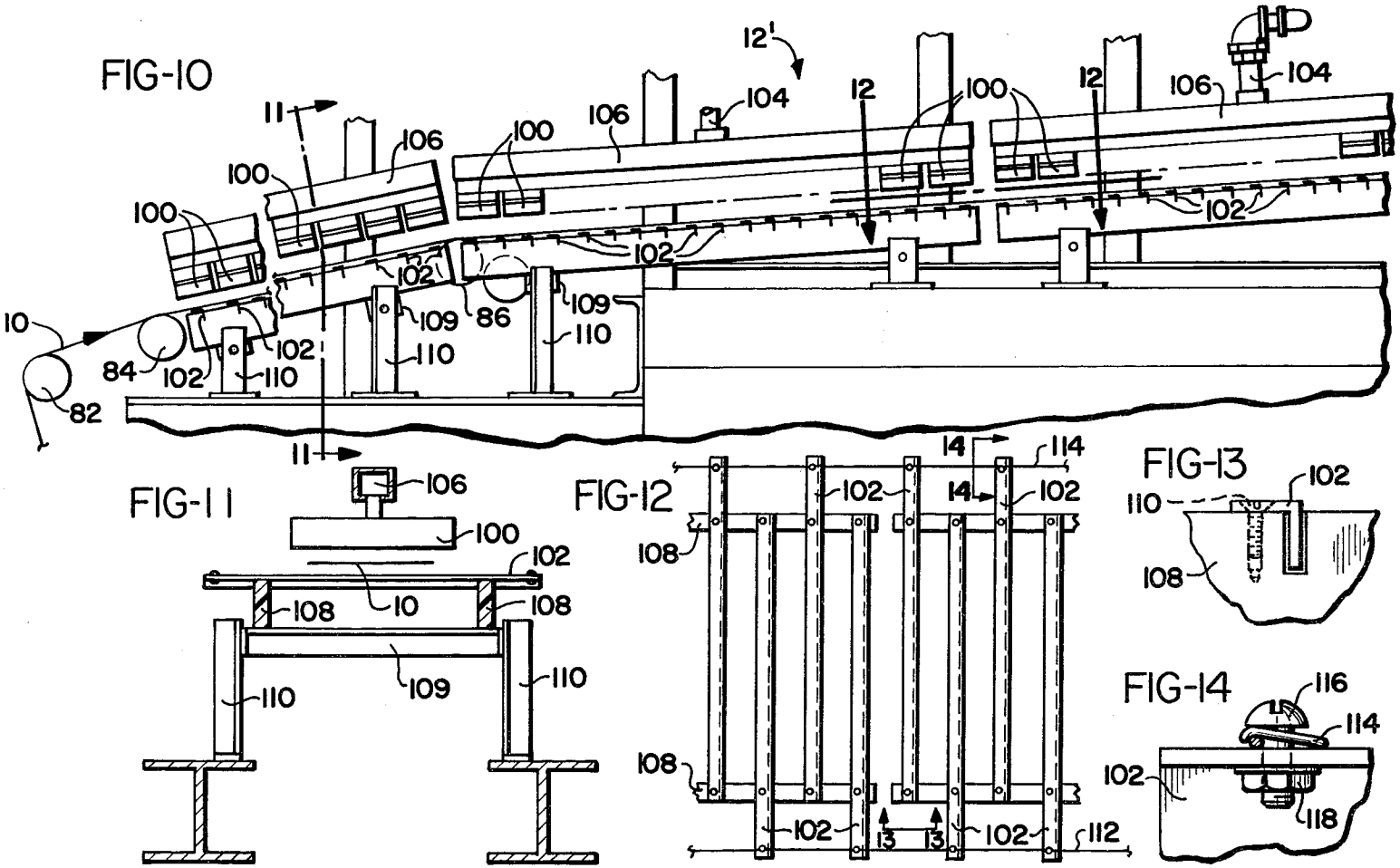
FIG. 10 is an enlarged view of the left-hand portion of FIG. 9, illustrating the third embodiment of the present invention in greater detail.
FIG. 11 is a sectional view taken generally along line 11—11 in FIG. 10.
FIG. 12 is a sectional view taken generally along line 12—12 in FIG. 10.
FIG. 13 is an enlarged view showing the electrode mounting arrangement of FIG. 12 as seen generally along line 13—13 in FIG. 12.
FIG. 14 is an enlarged partial sectional view taken generally along line 14—14 in FIG. 12.
Figure 15:
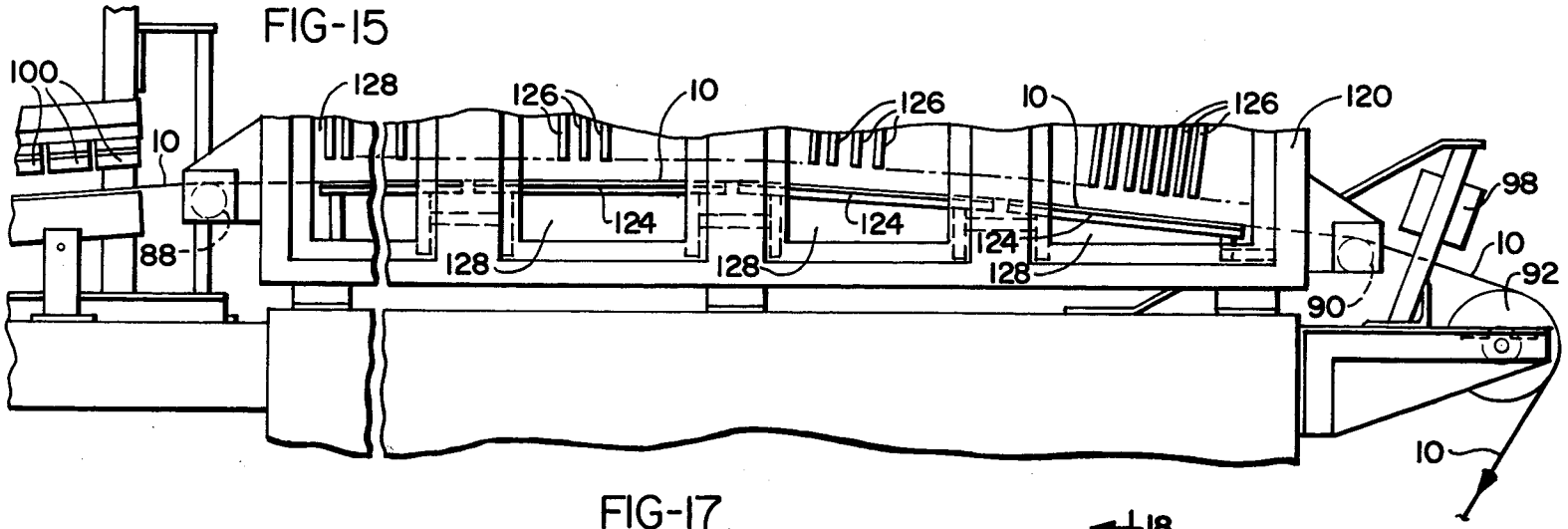
FIG. 15 is an enlarged view of the right-hand portion of FIG. 9 illustrating the fourth embodiment of the present invention in greater detail.
Figure 18:
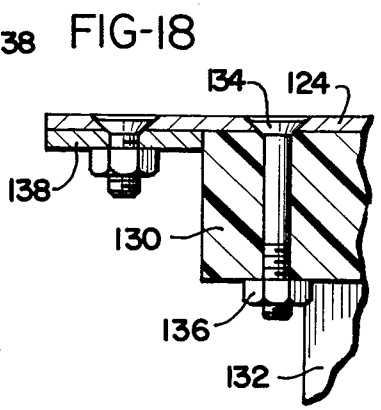
FIG. 18 is an enlarged sectional view taken generally along line 18—18 in FIG. 17.
Figure 17:
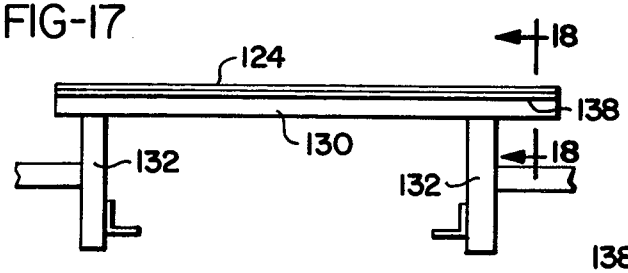
FIG. 17 is a partial view of the electrode and support structure of FIG. 16 as seen looking right to left in FIG. 16.
Figure 16:
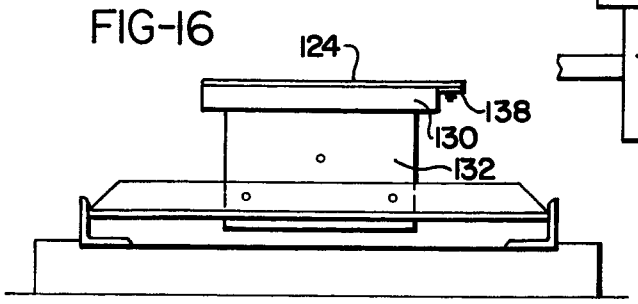
FIG. 16 is a view of an electrode and support structure of the embodiment of FIG. 15 as seen looking generally left to right in FIG. 15.

The constructional details of this embodiment of the invention are shown in FIGS. 10–14. As seen in FIGS. 10 and 11, each of the radiant burners 100 receives gas from a gas supply line 104 via an associated manifold 106. Each of the electrodes 102 is mounted to extend across the width of the web 100 by a pair of nonconductive electrode supports 108 which are attached to cross bars 109 extending between support legs 110. Web 10 is guided by rollers 82, 84, 86, and such additional rollers as may be needed, such that it passes above but does not contact the electrodes 102.

Electrodes 102 along the web 10 extend alternately beyond the electrode supports 108 in opposite directions. Each of the L-shaped electrodes 102 is secured to supports 108 by screws 110 and each is electrically connected to lines 112 or 114 by bolts 116 and nuts 118, as shown in FIGS. 13 and 14. An electrode structure is provided, therefore, in which alternate electrodes along the web path at the drying station can receive first and second static electrical potentials via lines 112 and 114, respectively. In tests conducted in which alternate electrodes received approximately 1200 volt static electrical potentials and the intermdiate electrodes were grounded, a drying rate increase averaging 1.6% was noted. Tests results for the third embodiment of the invention are summarized in appendix C of the present application.

Referring again to FIG. 9, the fourth embodiment of the present invention is depicted at drying station 12'' in which the heating means comprises means for directing heated air against the web 10. A closed drying tunnel 120 includes a manifold 122 to which heated air is supplied under pressure by appropriate aparatus (not shown). A plurality of electrode plates 124 are positioned in the tunnel dryer beneath the web 10 on the opposite side of the web from nozzles 126. Nozzles 126 communicate with the manifold 122 and direct heated air against the web 10. Static electrical potentials are applied to selected ones of the electrodes 124.

The constructional details of this embodiment of the invention are illustrated more fully in FIGS. 15–18. Dryer tunnel 120 is generally closed but defines openings at each end so that web 10 may pass therethrough. A number of access openings 128 are provided to permit threading and cleaning the dryer. Openings 128 are covered during operation of the dryer. Each of the electrodes 124 comprises a sheet of electrically conductive material which extends across the width of the web and provides a substantial electrode area. Each of the electrodes 124 is mounted on a nonconductive support table 130 which, in turn, is secured to table supports 132. Bolts 134 and nuts 136 extend through the electrodes 124 and secure them to the supports 130.

A bus bar 138 is attached to the edge of the electrodes 124, thus providing a means of supplying static electrical potentials to the electrodes. Alternatively, static potentials may be supplied to the electrodes by conductor wires connected to each of the electrodes. To restrict the current flow along the moisture web 10, between the electrodes 124 and the roll 88, it may be desirable to coat roll 88 with insulating material. Negligible current flow occurs between the electrodes 124 and roll 90, however, since at this point in the drying operation the web 10 is relatively dry. It has been found preferable to ground the first and third electrodes 124 and to supply a static electrical potential to the second and fourth of the electrodes encountered by the web as it moves through the drying tunnel. In various tests, potentials ranging between 0 and 25000 volts were applied to the alternate electrodes 124, with an average 5.7% increase in drying rate being noted. These tests results are summarized in appendix D.

The mechanism by which evaporation drying is enhanced by subjecting the liquid bearing web to a static electrical field is not fully understood, but one or more effects may contribute to produce this enhancement. Corona discharge may break down or reduce the thickness of the boundary layer at the surface of the moisture bearing web. The charge dipole effect by which water or other liquid molecules are aligned with a field, making them more easily evaporated through the boundary layer, may also contribute to the increase in evaporation drying rate. Additionally, the charge induced at the interface of the water and air may create an artificial surface tension which draws the volatile liquid to the surface more easily and thus enhances the evaporation rate. Finally, in the case of the drum dryer or the felted drum dryer, the electrostatic field may produce an attraction between the sheet and the drum which improves the heat transfer therebetween.

It will be appreciated that the drying system and method of the present invention have many applications. Drying of a moist paper web in a paper manufacturing operation may be enhanced by this technique. The present invention may be utilized to enhance evaporation of organic solvents or alcohols, as well as water. An electrostatic field may be utilized according to the present invention to dry a material web to which a liquid coating has been applied. Additionally, the present invention may be used for drying a web of fabric, felt, or other porous material. It should also be noted that ambient air may provide the necessary heating of the web in certain applications, without the need for an additional source of heat. Furthermore, the electrodes utilized may, if desired, extend only across a portion or portions of the web in order to provide moisture control in a direction perpendicular to the direction of web movement.

The following appendices summarize tests which are performed with the four embodiments of the invention described above. Appendix A summarizes test results with a drum dryer including a dryer felt. In run 120, however, the drum felt was not utilized for purposes of comparison to run 119. In both runs, no voltage was applied to the electrode wires. During runs 121-131, alternate electrode wires were grounded while a negative potential of the level indicated was applied to the intermediate electrode wires.

Appendix B summarizes test results for the unfelted drum dryer. During runs 43-69, a positive voltage was applied to all of the electrode wires. During run 70, a positive voltage was applied only to alternate electrode wires, with intermediate electrode wires being permitted to float. During run 71, a positive voltage was applied to alternate electrode wires, with intermediate electrode wires being grounded. During run 72, a negative voltage was applied to alternate electrode wires, with intermediate electrode wires being permitted to float. During run 73, a negative voltage was applied to alternate electrode wires, with intermediate electrode wires being grounded.

Appendix C summarizes the test results obtained with the radiant infrared drying embodiment. During runs 93-98, a positive potential was applied to all of the electrode bars. During run 99, a positive potential was applied to alternate electrode bars, with intermediate electrode bars being grounded. During runs 100-101, several of the "upstream" electrode bars were permitted to float, with the remaining electrode bars receiving a positive electrical potential.

Appendix D summarizes the test results obtained utilizing the tunnel dryer configuration. During runs 74-80, a negative voltage was applied to the electrode plates. During runs 81-85, a positive voltage was applied to the electrode plates. During runs 86 and 87, a positive voltage was applied to the electrode plates, with an insulating plastic cover covering the surface of roller 88. During run 88, a negative voltage was applied to the electrode plates with a plastic cover over roll 88. During runs 102-113, the first and alternate electrode plates were grounded while a positive voltage was applied to the other electrode plates.

The following abbreviations are used in appendices A-D:

CW is the coat weight (LB/3300 sq. ft.)
FM is the ratio of this means drying rate to the rate at zero volts.
KV is the applied voltage (thousands)
MA is the current load, milliamps
MO is the original total moisture, LB/LB
MT is the final moisture in that trial, LB/LB
P is the steam pressure in the drum (PSI)
RM is the mean drying rate (LB/HR/SQ. FT.)
SO is the coating solids
SP is the web speed (FPM)
T is the tunnel air temperature (°F)
TP is the sheet temperature leaving dryer (°F)

APPENDIX A

| P | SP | TP | KV | MA | MO | MT | RM | FM | RUN |
|---|---|---|---|---|---|---|---|---|---|
| 20.0 | 500.0 | | 0.00 | 0.00 | 0.2280 | 0.1330 | 5.918 | 1.000 | 120 |
| 20.0 | 500.0 | | 0.00 | 0.00 | 0.2280 | 0.0907 | 8.559 | 1.446 | 119 |
| 23.0 | 700.0 | 192.0 | 0.00 | 0.00 | 0.2492 | 0.1173 | 11.740 | 1.000 | 121 |
| 23.0 | 700.0 | 187.0 | 10.00 | 0.60 | 0.2492 | 0.1134 | 12.089 | 1.030 | 121 |
| 23.0 | 700.0 | 187.0 | 11.00 | 1.10 | 0.2492 | 0.1130 | 12.126 | 1.033 | 121 |
| 11.0 | 500.0 | 188.0 | 0.00 | 0.00 | 0.2396 | 0.0793 | 10.189 | 1.000 | 122 |
| 11.0 | 500.0 | 186.0 | 10.00 | 0.63 | 0.2396 | 0.0772 | 10.321 | 1.013 | 122 |
| 11.0 | 500.0 | 180.0 | 0.00 | 0.00 | 0.2581 | 0.1153 | 9.078 | 1.000 | 123 |
| 11.0 | 500.0 | 183.0 | 10.00 | 0.55 | 0.2581 | 0.1051 | 9.722 | 1.071 | 123 |
| 11.0 | 500.0 | 182.0 | 11.00 | 1.00 | 0.2581 | 0.1037 | 9.814 | 1.081 | 123 |
| 11.0 | 900.0 | 170.0 | 0.00 | 0.00 | 0.2658 | 0.1703 | 10.934 | 1.000 | 124 |
| 11.0 | 900.0 | 168.0 | 10.00 | 0.50 | 0.2658 | 0.1655 | 11.478 | 1.050 | 124 |

APPENDIX A-continued

| P | SP | TP | KV | MA | MO | MT | RM | FM | RUN |
|---|---|---|---|---|---|---|---|---|---|
| 23.0 | 700.0 | | 0.00 | 0.00 | 0.2492 | 0.1186 | 11.594 | 1.000 | 125 |
| 23.0 | 700.0 | | 10.00 | 0.60 | 0.2492 | 0.1103 | 12.328 | 1.063 | 125 |
| 11.0 | 900.0 | | 0.00 | 0.00 | 0.2175 | 0.1072 | 12.583 | 1.000 | 126 |
| 11.0 | 900.0 | | 10.00 | 0.60 | 0.2175 | 0.1000 | 13.408 | 1.066 | 126 |
| 11.0 | 900.0 | | 11.00 | 0.90 | 0.2175 | 0.0989 | 13.526 | 1.075 | 126 |
| 40.0 | 500.0 | | 0.00 | 0.00 | 0.2396 | 0.0400 | 12.648 | 1.000 | 127 |
| 40.0 | 500.0 | | 10.00 | 0.60 | 0.2396 | 0.0359 | 12.910 | 1.021 | 127 |
| 40.0 | 500.0 | | 0.00 | 0.00 | 0.2459 | 0.0659 | 11.069 | 1.000 | 128 |
| 40.0 | 500.0 | | 10.00 | 0.70 | 0.2459 | 0.0597 | 11.450 | 1.034 | 128 |
| 40.0 | 900.0 | | 0.00 | 0.00 | 0.2625 | 0.1634 | 10.961 | 1.000 | 129 |
| 40.0 | 900.0 | | 10.00 | 0.75 | 0.2625 | 0.1485 | 12.608 | 1.150 | 129 |
| 40.0 | 900.0 | | 0.00 | 0.00 | 0.2445 | 0.1103 | 14.854 | 1.000 | 130 |
| 40.0 | 900.0 | | 10.00 | 0.70 | 0.2445 | 0.1041 | 15.540 | 1.046 | 130 |
| 23.0 | 700.0 | | 0.00 | 0.00 | 0.2492 | 0.1155 | 11.512 | 1.000 | 131 |
| 23.0 | 700.0 | | 10.00 | 0.75 | 0.2492 | 0.1047 | 12.437 | 1.080 | 131 |

APPENDIX B

| P | SP | TP | CW | SO | KV | MA | MO | MT | RM | FM | RUN |
|---|---|---|---|---|---|---|---|---|---|---|---|
| 23.0 | 450.0 | 190.0 | 7.56 | 0.6060 | 0.00 | 0.00 | 0.1177 | 0.0543 | 3.537 | 1.000 | 43 |
| 23.0 | 450.0 | 175.0 | 7.56 | 0.6060 | 10.50 | 1.80 | 0.1177 | 0.0523 | 3.651 | 1.032 | 43 |
| 23.0 | 450.0 | 177.0 | 7.56 | 0.6060 | 12.00 | 2.00 | 0.1177 | 0.0519 | 3.671 | 1.038 | 43 |
| 11.0 | 350.0 | 175.0 | 7.13 | 0.6060 | 0.00 | 0.00 | 0.1141 | 0.0555 | 2.527 | 1.000 | 44 |
| 11.0 | 350.0 | 170.0 | 7.13 | 0.6060 | 10.00 | 1.70 | 0.1141 | 0.0540 | 2.592 | 1.026 | 44 |
| 11.0 | 350.0 | 170.0 | 7.13 | 0.6060 | 11.50 | 1.80 | 0.1141 | 0.0534 | 2.618 | 1.036 | 44 |
| 11.0 | 360.0 | 155.0 | 9.74 | 0.6060 | 0.00 | 0.00 | 0.1328 | 0.0926 | 1.906 | 1.000 | 45 |
| 11.0 | 360.0 | 145.0 | 9.74 | 0.6060 | 10.00 | 0.60 | 0.1328 | 0.0880 | 2.122 | 1.113 | 45 |
| 40.0 | 350.0 | 186.0 | 6.84 | 0.6172 | 0.00 | 0.00 | 0.1051 | 0.0516 | 2.430 | 1.000 | 52 |
| 40.0 | 350.0 | 180.0 | 6.84 | 0.6172 | 10.00 | 0.40 | 0.1051 | 0.0504 | 2.484 | 1.022 | 52 |
| 40.0 | 650.0 | 195.0 | 4.08 | 0.6172 | 0.00 | 0.00 | 0.0831 | 0.0462 | 2.991 | 1.000 | 53 |
| 23.0 | 450.0 | 180.0 | 5.53 | 0.6172 | 0.00 | 0.00 | 0.0949 | 0.0504 | 2.549 | 1.000 | 54 |
| 23.0 | 450.0 | 175.0 | 5.53 | 0.6172 | 10.00 | 0.45 | 0.0949 | 0.0490 | 2.628 | 1.031 | 54 |
| 23.0 | 450.0 | 175.0 | 5.53 | 0.6172 | 11.00 | 0.70 | 0.0949 | 0.0486 | 2.652 | 1.040 | 54 |
| 23.0 | 450.0 | 183.0 | 4.22 | 0.6172 | 0.00 | 0.00 | 0.0843 | 0.0462 | 2.140 | 1.000 | 55 |
| 23.0 | 450.0 | 177.0 | 4.22 | 0.6172 | 10.00 | 0.60 | 0.0843 | 0.0448 | 2.218 | 1.036 | 55 |
| 23.0 | 450.0 | 180.0 | 4.22 | 0.6172 | 12.00 | 1.20 | 0.0843 | 0.0440 | 2.265 | 1.058 | 55 |
| 23.0 | 450.0 | 180.0 | 9.60 | 0.6172 | 0.00 | 0.00 | 0.1293 | 0.0711 | 3.366 | 1.000 | 56 |
| 23.0 | 450.0 | 170.0 | 9.60 | 0.6172 | 10.00 | 0.60 | 0.1293 | 0.0691 | 3.480 | 1.034 | 56 |
| 23.0 | 450.0 | 160.0 | 9.60 | 0.6172 | 12.00 | 1.30 | 0.1293 | 0.0690 | 3.487 | 1.036 | 56 |
| 23.0 | 300.0 | 185.0 | 8.29 | 0.6172 | 0.00 | 0.00 | 0.1195 | 0.0462 | 2.770 | 1.000 | 57 |
| 23.0 | 300.0 | 180.0 | 8.29 | 0.6172 | 10.00 | 0.50 | 0.1195 | 0.0450 | 2.816 | 1.016 | 57 |
| 23.0 | 300.0 | 180.0 | 8.29 | 0.6172 | 11.00 | 0.70 | 0.1195 | 0.0447 | 2.827 | 1.020 | 57 |
| 23.0 | 900.0 | 195.0 | 5.53 | 0.6172 | 0.00 | 0.00 | 0.0976 | 0.0549 | 4.630 | 1.000 | 58 |
| 23.0 | 900.0 | 190.0 | 5.53 | 0.6172 | 12.00 | 3.50 | 0.0976 | 0.0534 | 4.793 | 1.035 | 58 |
| 23.0 | 450.0 | 183.0 | 5.54 | 0.6172 | 0.00 | 0.00 | 0.0951 | 0.0570 | 2.177 | 1.000 | 60 |
| 23.0 | 450.0 | 175.0 | 5.54 | 0.6172 | 10.00 | 0.60 | 0.0951 | 0.0555 | 2.263 | 1.039 | 60 |
| 23.0 | 450.0 | 175.0 | 5.54 | 0.6172 | 11.00 | 0.90 | 0.0951 | 0.0549 | 2.297 | 1.055 | 60 |
| 23.0 | 450.0 | 172.0 | 5.54 | 0.6172 | 12.00 | 1.30 | 0.0951 | 0.0543 | 2.331 | 1.071 | 60 |
| 5.0 | 450.0 | 180.0 | 7.87 | 0.6172 | 0.00 | 0.00 | 0.1129 | 0.0636 | 2.920 | 1.000 | 61 |
| 5.0 | 450.0 | 170.0 | 7.87 | 0.6172 | 10.00 | 0.60 | 0.1129 | 0.0624 | 2.991 | 1.024 | 61 |
| 5.0 | 450.0 | 165.0 | 7.87 | 0.6172 | 12.50 | 1.50 | 0.1129 | 0.0618 | 3.026 | 1.036 | 61 |
| 53.0 | 450.0 | 190.0 | 8.45 | 0.6172 | 0.00 | 0.00 | 0.1172 | 0.0558 | 3.664 | 1.000 | 62 |
| 53.0 | 450.0 | 185.0 | 8.45 | 0.6172 | 10.00 | 0.60 | 0.1172 | 0.0540 | 3.772 | 1.029 | 62 |
| 53.0 | 450.0 | 180.0 | 8.45 | 0.6172 | 11.00 | 0.75 | 0.1172 | 0.0534 | 3.807 | 1.039 | 62 |
| 11.0 | 650.0 | 185.0 | 8.29 | 0.6104 | 0.00 | 0.00 | 0.1185 | 0.0728 | 3.915 | 1.000 | 63 |
| 11.0 | 650.0 | 180.0 | 8.29 | 0.6104 | 10.00 | 1.00 | 0.1185 | 0.0710 | 4.064 | 1.038 | 63 |
| 11.0 | 650.0 | 177.0 | 8.29 | 0.6104 | 12.00 | 1.70 | 0.1185 | 0.0705 | 4.110 | 1.050 | 63 |
| 11.0 | 650.0 | 160.0 | 15.42 | 0.6104 | 0.00 | 0.00 | 0.1674 | 0.0708 | 9.132 | 1.000 | 64 |
| 11.0 | 650.0 | 150.0 | 15.42 | 0.6104 | 10.00 | 0.50 | 0.1674 | 0.0706 | 9.149 | 1.002 | 64 |
| 11.0 | 650.0 | 145.0 | 15.42 | 0.6104 | 11.00 | 0.70 | 0.1674 | 0.0697 | 9.234 | 1.011 | 64 |
| 23.0 | 450.0 | 180.0 | 9.16 | 0.6104 | 0.00 | 0.00 | 0.1255 | 0.0584 | 4.005 | 1.000 | 65 |
| 23.0 | 450.0 | 170.0 | 9.16 | 0.6104 | 10.00 | 0.40 | 0.1255 | 0.0572 | 4.073 | 1.017 | 65 |
| 40.0 | 350.0 | 183.0 | 14.25 | 0.6104 | 0.00 | 0.00 | 0.1607 | 0.0712 | 4.460 | 1.000 | 66 |
| 40.0 | 350.0 | 168.0 | 14.25 | 0.6104 | 10.00 | 0.70 | 0.1607 | 0.0676 | 4.637 | 1.040 | 66 |
| 42.0 | 350.0 | 164.0 | 14.25 | 0.6104 | 11.00 | 1.20 | 0.1607 | 0.0634 | 4.846 | 1.086 | 66 |
| 40.0 | 650.0 | 174.0 | 15.56 | 0.6104 | 0.00 | 0.00 | 0.1689 | 0.0782 | 8.544 | 1.000 | 67 |
| 40.0 | 650.0 | 168.0 | 15.56 | 0.6104 | 10.00 | 0.70 | 0.1689 | 0.0775 | 8.611 | 1.008 | 67 |
| 40.0 | 650.0 | 164.0 | 15.56 | 0.6104 | 11.00 | 1.00 | 0.1689 | 0.0770 | 8.657 | 1.013 | 67 |
| 40.0 | 650.0 | 195.0 | 9.02 | 0.6104 | 0.00 | 0.00 | 0.1248 | 0.0528 | 6.165 | 1.000 | 68 |
| 40.0 | 650.0 | 185.0 | 9.02 | 0.6104 | 10.00 | 4.00 | 0.1248 | 0.0507 | 6.345 | 1.029 | 68 |
| 23.0 | 450.0 | 180.0 | 13.23 | 0.6104 | 0.00 | 0.00 | 0.1544 | 0.0780 | 4.811 | 1.000 | 69 |
| 23.0 | 450.0 | 173.0 | 13.23 | 0.6104 | 10.00 | 0.45 | 0.1544 | 0.0767 | 4.894 | 1.017 | 69 |
| 23.0 | 450.0 | 164.0 | 13.23 | 0.6104 | 12.00 | 1.30 | 0.1544 | 0.0750 | 5.000 | 1.039 | 69 |
| 23.0 | 450.0 | 177.0 | 11.63 | 0.6104 | 0.00 | 0.00 | 0.1436 | 0.0784 | 4.014 | 1.000 | 70 |
| 23.0 | 450.0 | 170.0 | 11.63 | 0.6104 | 10.00 | 0.60 | 0.1436 | 0.0762 | 4.147 | 1.033 | 70 |
| 23.0 | 450.0 | 172.0 | 11.63 | 0.6104 | 11.00 | 0.80 | 0.1436 | 0.0756 | 4.184 | 1.042 | 70 |
| 23.0 | 450.0 | 173.0 | 12.22 | 0.6104 | 0.00 | 0.00 | 0.1476 | 0.0796 | 4.221 | 1.000 | 71 |
| 23.0 | 450.0 | 172.0 | 12.22 | 0.6104 | 10.00 | 0.80 | 0.1476 | 0.0700 | 4.817 | 1.141 | 71 |
| 23.0 | 450.0 | 165.0 | 12.22 | 0.6104 | 11.00 | 1.90 | 0.1476 | 0.0695 | 4.847 | 1.148 | 71 |

APPENDIX B-continued

| P | SP | TP | CW | SO | KV | MA | MO | MT | RM | FM | RUN |
|---|---|---|---|---|---|---|---|---|---|---|---|
| 23.0 | 450.0 | 180.0 | 8.29 | 0.6104 | 0.00 | 0.00 | 0.1163 | 0.0792 | 2.269 | 1.000 | 72 |
| 23.0 | 450.0 | 173.0 | 8.29 | 0.6104 | 10.00 | 0.60 | 0.1163 | 0.0747 | 2.544 | 1.121 | 72 |
| 23.0 | 450.0 | 168.0 | 8.29 | 0.6104 | 11.00 | 1.10 | 0.1163 | 0.0746 | 2.552 | 1.125 | 72 |
| 23.0 | 450.0 | 172.0 | 8.29 | 0.6104 | 12.00 | 2.10 | 0.1163 | 0.0738 | 2.599 | 1.146 | 72 |
| 23.0 | 450.0 | 163.0 | 8.29 | 0.6104 | 13.00 | 4.80 | 0.1163 | 0.0732 | 2.636 | 1.162 | 72 |
| 23.0 | 450.0 | 185.0 | 9.45 | 0.6104 | 0.00 | 0.00 | 0.1255 | 0.0753 | 3.090 | 1.000 | 73 |
| 23.0 | 450.0 | 175.0 | 9.46 | 0.6104 | 10.00 | 2.20 | 0.1255 | 0.0679 | 3.549 | 1.149 | 73 |
| 23.0 | 450.0 | 170.0 | 9.45 | 0.6104 | 11.00 | 2.60 | 0.1255 | 0.0676 | 3.562 | 1.153 | 73 |
| 23.0 | 450.0 | 164.0 | 9.45 | 0.6104 | 12.00 | 4.00 | 0.1255 | 0.0670 | 3.603 | 1.166 | 73 |
| 23.0 | 450.0 | 155.0 | 9.45 | 0.6104 | 14.00 | 9.50 | 0.1255 | 0.0660 | 3.662 | 1.185 | 73 |

APPENDIX C

| SP | TP | CW | SO | KV | PA | MO | MT | RM | FM | RUN |
|---|---|---|---|---|---|---|---|---|---|---|
| 900.0 | 165.0 | 7.42 | 0.5900 | 0.00 | 0.00 | 0.1374 | 0.0751 | 7.712 | 1.000 | 93 |
| 900.0 | 160.0 | 7.42 | 0.5900 | 2.50 | 13.00 | 0.1374 | 0.0742 | 7.831 | 1.015 | 93 |
| 600.0 | 2504.0 | 8.88 | 0.5900 | 0.00 | 0.00 | 0.1504 | 0.0511 | 8.395 | 1.000 | 94 |
| 600.0 | 2504.0 | 8.88 | 0.5900 | 1.50 | 13.00 | 0.1504 | 0.0486 | 8.612 | 1.026 | 94 |
| 600.0 | 230.0 | 11.64 | 0.5900 | 0.00 | 0.00 | 0.1734 | 0.0527 | 10.656 | 1.000 | 95 |
| 600.0 | 250.0 | 11.64 | 0.5900 | 1.00 | 13.00 | 0.1734 | 0.0508 | 10.825 | 1.016 | 95 |
| 600.0 | 235.0 | 11.35 | 0.5900 | 0.00 | 0.00 | 0.1710 | 0.0527 | 10.404 | 1.000 | 96 |
| 600.0 | 240.0 | 11.35 | 0.5900 | 0.50 | 13.00 | 0.1710 | 0.0511 | 10.545 | 1.014 | 96 |
| 1200.0 | 200.0 | 10.18 | 0.5900 | 0.00 | 0.00 | 0.1607 | 0.0947 | 11.489 | 1.000 | 97 |
| 1200.0 | 200.0 | 10.18 | 0.5900 | 1.00 | 13.00 | 0.1548 | 0.0934 | 11.357 | 0.989 | 97 |
| 1200.0 | 200.0 | 7.42 | 0.5900 | 0.00 | 0.00 | 0.1321 | 0.0801 | 9.230 | 1.000 | 98 |
| 1200.0 | 210.0 | 7.42 | 0.5900 | 0.70 | 13.00 | 0.1321 | 0.0799 | 9.252 | 1.002 | 98 |
| 1200.0 | 225.0 | 7.86 | 0.5900 | 0.00 | 0.00 | 0.1359 | 0.0767 | 10.555 | 1.000 | 99 |
| 1200.0 | 210.0 | 7.86 | 0.5900 | 0.50 | 13.00 | 0.1359 | 0.0751 | 10.841 | 1.027 | 99 |
| 900.0 | 205.0 | 11.34 | 0.5900 | 0.00 | 0.00 | 0.1640 | 0.0847 | 11.158 | 1.000 | 100 |
| 900.0 | 215.0 | 11.34 | 0.5900 | 1.50 | 13.00 | 0.1640 | 0.0844 | 11.203 | 1.004 | 100 |
| 900.0 | 205.0 | 11.34 | 0.5900 | 0.00 | 0.00 | 0.1640 | 0.0835 | 11.338 | 1.000 | 100 |
| 900.0 | 210.0 | 11.34 | 0.5900 | 1.20 | 1300 | 0.1640 | 0.0819 | 11.563 | 1.020 | 100 |
| 900.0 | 220.0 | 7.56 | 0.5900 | 0.00 | 0.00 | 0.1335 | 0.0697 | 8.481 | 1.000 | 101 |
| 900.0 | 220.0 | 7.56 | 0.5900 | 1.50 | 13.00 | 0.1335 | 0.0684 | 8.652 | 1.020 | 101 |

APPENDIX D

| T | SP | TP | CW | SO | KV | MA | MO | MT | RM | FM | RUN |
|---|---|---|---|---|---|---|---|---|---|---|---|
| 350.0 | 900.0 | 125.0 | 9.16 | 0.6199 | 0.00 | 0.00 | 0.1357 | 0.1132 | 3.061 | 1.000 | 74 |
| 350.0 | 900.0 | 137.0 | 9.16 | 0.6199 | 5.30 | 13.00 | 0.1357 | 0.1113 | 3.323 | 1.085 | 74 |
| 250.0 | 1200.0 | 115.0 | 9.60 | 0.6199 | 0.00 | 0.00 | 0.1388 | 0.1123 | 4.852 | 1.000 | 75 |
| 250.0 | 1200.0 | 110.0 | 9.60 | 0.6199 | 3.00 | 13.00 | 0.1388 | 0.1100 | 5.261 | 1.084 | 75 |
| 350.0 | 600.0 | 148.0 | 10.32 | 0.6199 | 0.00 | 0.00 | 0.1461 | 0.0973 | 4.385 | 1.000 | 76 |
| 350.0 | 600.0 | 157.0 | 10.32 | 0.6199 | 7.20 | 13.00 | 0.1461 | 0.0940 | 4.684 | 1.068 | 76 |
| 350.0 | 400.0 | 168.0 | 8.87 | 0.6199 | 0.00 | 0.00 | 0.1357 | 0.0767 | 3.461 | 1.000 | 77 |
| 350.0 | 400.0 | 176.0 | 8.87 | 0.6199 | 10.00 | 13.00 | 0.1357 | 0.0723 | 3.720 | 1.075 | 77 |
| 450.0 | 400.0 | 195.0 | 8.87 | 0.6199 | 0.00 | 0.00 | 0.1357 | 0.0670 | 4.028 | 1.000 | 78 |
| 450.0 | 400.0 | 188.0 | 8.87 | 0.6199 | 10.00 | 13.00 | 0.1357 | 0.0618 | 4.331 | 1.075 | 78 |
| 350.0 | 300.0 | 174.0 | 9.30 | 0.6199 | 0.00 | 0.00 | 0.1389 | 0.0671 | 3.174 | 1.000 | 79 |
| 350.0 | 300.0 | 180.0 | 9.30 | 0.6199 | 10.00 | 13.00 | 0.1389 | 0.0620 | 3.400 | 1.071 | 79 |
| 450.0 | 300.0 | 207.0 | 9.16 | 0.6199 | 0.00 | 0.00 | 0.1378 | 0.0543 | 3.687 | 1.000 | 80 |
| 450.0 | 300.0 | 218.0 | 9.16 | 0.6199 | 10.00 | 13.00 | 0.1378 | 0.0502 | 3.868 | 1.049 | 80 |
| 350.0 | 400.0 | 185.0 | 9.31 | 0.6199 | 0.00 | 0.00 | 0.1405 | 0.0705 | 4.048 | 1.000 | 81 |
| 350.0 | 400.0 | 192.0 | 9.31 | 0.6199 | 10.00 | 13.00 | 0.1405 | 0.0652 | 4.356 | 1.076 | 81 |
| 450.0 | 400.0 | 198.0 | 9.31 | 0.6199 | 0.00 | 0.00 | 0.1405 | 0.0611 | 4.596 | 1.000 | 82 |
| 450.0 | 400.0 | 210.0 | 9.31 | 0.6199 | 10.00 | 13.00 | 0.1405 | 0.0572 | 4.818 | 1.048 | 82 |
| 450.0 | 300.0 | 227.0 | 10.18 | 0.6199 | 0.00 | 0.00 | 0.1469 | 0.0491 | 4.298 | 1.000 | 83 |
| 450.0 | 300.0 | 250.0 | 10.18 | 0.6199 | 10.00 | 13.00 | 0.1469 | 0.0454 | 4.461 | 1.038 | 83 |
| 350.0 | 300.0 | 190.0 | 9.31 | 0.6199 | 0.00 | 0.00 | 0.1405 | 0.0703 | 3.045 | 1.000 | 84 |
| 350.0 | 300.0 | 190.0 | 9.31 | 0.6199 | 10.00 | 13.00 | 0.1405 | 0.0670 | 3.189 | 1.047 | 84 |
| 250.0 | 300.0 | 168.0 | 9.16 | 0.6199 | 0.00 | 0.00 | 0.1394 | 0.0703 | 2.990 | 1.000 | 85 |
| 250.0 | 300.0 | 168.0 | 9.16 | 0.6199 | 10.00 | 13.00 | 0.1394 | 0.0670 | 3.134 | 1.048 | 85 |
| 350.0 | 400.0 | 183.0 | 9.30 | 0.6199 | 0.00 | 0.00 | 0.1389 | 0.0707 | 4.024 | 1.000 | 86 |
| 350.0 | 400.0 | 187.0 | 9.30 | 0.6199 | 20.00 | 5.50 | 0.1389 | 0.0687 | 4.141 | 1.029 | 86 |
| 350.0 | 400.0 | 183.0 | 9.30 | 0.6199 | 23.00 | 13.00 | 0.1389 | 0.0683 | 4.164 | 1.035 | 86 |
| 450.0 | 400.0 | 197.0 | 8.58 | 0.6199 | 0.00 | 0.00 | 0.1336 | 0.0616 | 4.202 | 1.000 | 87 |
| 450.0 | 400.0 | 198.0 | 8.58 | 0.6199 | 20.00 | 6.50 | 0.1336 | 0.0598 | 4.307 | 1.025 | 87 |
| 450.0 | 400.0 | 197.0 | 8.58 | 0.6199 | 23.00 | 13.00 | 0.1336 | 0.0590 | 4.352 | 1.036 | 87 |
| 450.0 | 400.0 | 195.0 | 8.58 | 0.6199 | 0.00 | 0.00 | 0.1336 | 0.0616 | 4.202 | 1.000 | 88 |
| 450.0 | 400.0 | 197.0 | 8.58 | 0.6199 | 20.00 | 6.00 | 0.1336 | 0.0591 | 4.344 | 1.034 | 88 |
| 350.0 | 500.0 | 178.0 | 5.82 | 0.5850 | 0.00 | 0.00 | 0.1182 | 0.0673 | 3.745 | 1.000 | 102 |
| 350.0 | 500.0 | 184.0 | 5.82 | 0.5850 | 5.00 | 13.00 | 0.1182 | 0.0620 | 4.131 | 1.103 | 102 |
| 250.0 | 300.0 | 164.0 | 5.53 | 0.5850 | 0.00 | 0.00 | 0.1155 | 0.0588 | 2.492 | 1.000 | 103 |
| 250.0 | 300.0 | 168.0 | 5.53 | 0.5850 | 10.00 | 11.00 | 0.1155 | 0.0558 | 2.625 | 1.053 | 103 |
| 250.0 | 300.0 | 155.0 | 8.15 | 0.5850 | 0.00 | 0.00 | 0.1385 | 0.0959 | 1.948 | 1.000 | 104 |
| 250.0 | 300.0 | 162.0 | 8.15 | 0.5850 | 5.00 | 13.00 | 0.1385 | 0.0779 | 2.773 | 1.424 | 104 |
| 450.0 | 300.0 | 225.0 | 7.27 | 0.5850 | 0.00 | 0.00 | 0.1329 | 0.0460 | 3.818 | 1.000 | 107 |
| 450.0 | 300.0 | 243.0 | 7.27 | 0.5850 | 10.00 | 13.00 | 0.1329 | 0.0447 | 3.874 | 1.015 | 107 |

APPENDIX D-continued

| T | SP | TP | CW | SO | KV | MA | MO | MT | RM | FM | RUN |
|---|---|---|---|---|---|---|---|---|---|---|---|
| 450.0 | 300.0 | 207.0 | 9.30 | 0.5850 | 0.00 | 0.00 | 0.1504 | 0.0505 | 4.525 | 1.000 | 108 |
| 450.0 | 300.0 | 220.0 | 9.30 | 0.5850 | 10.00 | 11.00 | 0.1504 | 0.0460 | 4.728 | 1.045 | 108 |
| 450.0 | 700.0 | 168.0 | 9.58 | 0.5850 | 0.00 | 0.00 | 0.1527 | 0.0873 | 6.944 | 1.000 | 109 |
| 450.0 | 700.0 | 175.0 | 9.58 | 0.5850 | 1.00 | 13.00 | 0.1527 | 0.0853 | 7.161 | 1.031 | 109 |
| 450.0 | 700.0 | 174.0 | 6.54 | 0.5850 | 0.00 | 0.00 | 0.1264 | 0.0819 | 4.513 | 1.000 | 110 |
| 450.0 | 700.0 | 185.0 | 6.54 | 0.5850 | 2.00 | 13.00 | 0.1264 | 0.0793 | 4.772 | 1.057 | 110 |
| 350.0 | 500.0 | 173.0 | 5.09 | 0.5850 | 0.00 | 0.00 | 0.1129 | 0.0758 | 2.629 | 1.000 | 111 |
| 350.0 | 500.0 | 177.0 | 5.09 | 0.5850 | 2.00 | 8.50 | 0.1129 | 0.0725 | 2.864 | 1.090 | 111 |
| 350.0 | 500.0 | 170.0 | 5.09 | 0.5850 | 3.00 | 13.00 | 0.1129 | 0.0717 | 2.914 | 1.109 | 111 |
| 350.0 | 500.0 | 185.0 | 6.83 | 0.5850 | 0.00 | 0.00 | 0.1290 | 0.0694 | 4.336 | 1.000 | 112 |
| 350.0 | 500.0 | 192.0 | 6.83 | 0.5850 | 2.00 | 8.50 | 0.1290 | 0.0677 | 4.462 | 1.029 | 112 |
| 450.0 | 700.0 | 185.0 | 5.81 | 0.5850 | 0.00 | 0.00 | 0.1197 | 0.0719 | 4.784 | 1.000 | 113 |
| 450.0 | 700.0 | 192.0 | 5.81 | 0.5850 | 3.00 | 9.00 | 0.1197 | 0.0700 | 4.977 | 1.040 | 113 |

While the apparatus herein described and the method by which the apparatus operates constitute preferred embodiments of the invention, it is to be understood that the invention is not limited to this precise method and forms of apparatus, and that changes may be made in either without departing from the scope of the invention.

What is claimed is:

1. A drying system for removing volatile liquid from a liquid bearing web of material by evaporation, comprising:

means for moving a liquid bearing web of material through a drying station, heating means, including means on a first side of said web for directing heated air against said first side of a portion of said web at said drying station, for applying evaporation energy to said liquid bearing web of material to effect evaporation of said liquid from said web, and electrostatic means, on a second side of said web directly opposite said heating means, for simultaneously subjecting said portion of said web of material to a static electrical field at said drying station, whereby the evaporation of volatile liquid from said web is enhanced, said electrostatic means comprising:

a plurality of electrodes positioned at said drying station and spaced apart along said web on a second side thereof opposite said first side, said electrodes being positioned directly opposite said heating means, and means for supplying a first static electrical potential to selected ones of said electrodes, and for supplying a second static electrical potential to the others of said electrodes.

2. The drying system of claim 1 in which said heating means includes means for directing heated air of about 250°–450° F. against said web of said drying station.

3. The drying system of claim 1 in which each of said plurality of electrodes comprises a sheet of electrically conductive material extending across the width of said web and providing a substantial electrode area.

4. The drying system of claim 1 in which said first static electrical potential is applied to the first and alternate electrodes along said web and in which said second static electrical potential is applied to electrodes positioned intermediate said first and alternate electrodes.

5. The drying system of claim 4 in which one of said first and second static electrical potentials is ground potential.

6. The drying system of claim 5 in which said first and alternate electrodes are grounded and a positive electrical potential is applied to said electrodes intermediate said first and alternate electrodes.

7. A method for removing volatile liquid from a liquid bearing web of material by evaporation, comprising the steps of:

(a) moving a liquid bearing web of material through a drying station, (b) directing heated air against a portion of a first side of said liquid bearing web to effect evaporation of said liquid, and (c) simultaneously subjecting substantially all of said portion of said liquid bearing web of material to a static electrical field provided by electrostatic means comprising a plurality of electrodes positioned at said drying station along said web on a second side thereof opposite said first side, and means for supplying a first static electrical potential to selected ones of said electrodes and for supplying a second static electrical potential to the others of said electrodes, whereby evaporation of said liquid from said web is enhanced by simultaneously subjecting substantially all of said portion of said web to both heated air and a static electrical field.

8. The process of claim 7 in which said first static electrical potential is applied to the first and alternate electrodes along said web and in which said second static electrical potential is applied to electrodes positioned intermediate said first and alternate electrodes.

9. The process of claim 8 wherein one of said first and second static electrical potentials is ground.

10. The process of claim 9 wherein said first and alternate electrodes are grounded and a positive electrical potential is applied to said electrodes intermediate said first and alternate electrodes.

11. The process of claims 7 or 10 wherein said heated air is heated to a temperature of about 250° to 450° F.

* * * * *